US006585743B2

(12) United States Patent
Dolev

(10) Patent No.: US 6,585,743 B2
(45) Date of Patent: Jul. 1, 2003

(54) HAIR DEPILATING DEVICE UTILIZING MECHANISM TO SPIRALLY ALIGN COUPLED-TWEEZER ELEMENTS

(76) Inventor: Moshe Dolev, 17 Rehov Bereishit, Ramat HaSharon (IL), 47201

( * ) Notice: Subject to any disclaimer, the term of this patent is extended or adjusted under 35 U.S.C. 154(b) by 27 days.

(21) Appl. No.: 09/875,004

(22) Filed: Jun. 7, 2001

(65) Prior Publication Data

US 2001/0051808 A1 Dec. 13, 2001

Related U.S. Application Data

(60) Provisional application No. 60/210,493, filed on Jun. 9, 2000.

(51) Int. Cl.[7] ..... A45D 26/00
(52) U.S. Cl. ..... 606/133; 606/131
(58) Field of Search ..... 606/133, 131, 606/132, 210; 452/82, 83, 85; 219/233, 223, 384

(56) References Cited

U.S. PATENT DOCUMENTS

| | | | | | |
|---|---|---|---|---|---|
| 5,041,123 | A | * | 8/1991 | Oliveau et al. | 606/133 |
| 5,281,233 | A | * | 1/1994 | Dolev | 606/131 |
| 5,462,557 | A | * | 10/1995 | Jordan et al. | 606/131 |
| 5,857,903 | A | * | 1/1999 | Ramspeck et al. | 452/82 |
| 5,976,157 | A | * | 11/1999 | Yiu | 425/71 |
| 6,287,190 | B1 | * | 9/2001 | Inoue et al. | 452/82 |
| 6,322,569 | B1 | * | 11/2001 | Sueyoshi et al. | 606/133 |

* cited by examiner

*Primary Examiner*—Pedro Philogene
(74) *Attorney, Agent, or Firm*—Edward Langer; Shiboleth, Yisraeli, Roberts, Zisman & Co.

(57) ABSTRACT

A motor-powered depilatory device employing a hair-plucking assembly containing a right hand actuator element and a left hand actuator element, identical in construction, each carrying opposing tweezer elements, which fit together in interleaved fashion, arranged to define hair-traps, with the hair-plucking assembly being rotatable about a central shaft and operable to close and open the hair-traps by a system of cams and springs. The device is designed to allow for self-alignment of the tweezer elements, ensuring that all tweezer elements close simultaneously during a revolution of the hair-plucking assembly, with no excessive applied force being required, thus enabling uniform distribution of gripping force among all hair-traps, despite inaccuracies in manufacture. Quality of hair plucking is thereby improved, where quality of plucking is defined as the percentage of hairs plucked versus percentage of hairs cut. The actuator elements are arranged to provide slots for installation of a plurality rows of tweezer elements, arranged in a staggered, rather than tandem arrangement, which contributes to a much more even treatment of the skin surface, and to an increase in the speed of removal of hairs from a given area, thus leading to reduced energy consumption per unit of time. A further advantage of the present invention is a continuous cam design, eliminating the need to jump from one cam to another, and this configuration decreases noise levels, reduces energy requirements and reduces wear and tear of the device.

19 Claims, 13 Drawing Sheets

HAIR DEPILATING DEVICE UTILIZING MECHANISM TO SPIRALLY ALIGN COUPLED-TWEEZER ELEMENTS

This application claims the benefit of Provisional application Ser. No. 60/210,493, filed Jun. 9, 2000.

FIELD OF THE INVENTION

The present invention relates to a hand held, motorized depilatory device for removing unwanted skin hair, and more particularly, to a revolutionary concept and mechanically correct design to pluck out skin hair, utilizing a novel mechanism to spirally align coupled-tweezer elements.

BACKGROUND OF THE INVENTION

The prior art of motor-powered depilatory devices for removing skin hair is based on a well-known concept disclosed in a patent covering an earlier mechanical device, Swiss Patent 268,696 to Fischer. There, a helical spring is arched, to provide spaces between loops of its convex side, and the spring is placed on the skin, under slight pressure, and rolled, in the direction of hair growth. The rolling motion of the helical spring causes hairs, which become trapped in the spaces, between the coil loops, on the convex side, to be plucked, when these spaces close, on the coil spring concave side.

U.S. Pat. No. 4,524,772 to Daar, et. al., discloses an arched, helical spring, which is provided with high speed, rotational motion via motor-driven couplings, connected at its ends. The contact between the helical spring wire and individual hairs is essentially point-like. A hair that is caught between the closed spring loops may be released before the plucking operation has been completed, which results in inefficient plucking and unnecessary pain.

Once a hair becomes trapped between closed helical spring loops, continued application of rotational force causes the spring to "wind up", since it is composed of flexible wire material, yet the hair is still in place. As the spring continues to "wind", the pulling tension applied to the hair increases until the necessary force is developed for plucking. Because a finite interval is required for this force to be developed, the user is subjected to an increased pain level.

The helical spring may break during use, due to the continuous bending stresses applied to it, creating a hazard to the user, as the spring is in direct contact with the skin.

In addition, a transverse deflection of hairs takes place, due to lateral movement of the spaces between the helical spring loops, which rotate in spiral fashion. Therefore, shorter hairs tend to escape the traps, created by the helical spring loops.

In U.S. Pat. No. 4,575,902 to Alazet, there is disclosed a depilatory device, comprising a series of adjacent, closely-spaced hair-plucking discs, driven by an electric motor, housed within a casing. The discs are periodically deformed during their rotation, such that adjacent ones, thereof, are pressed together to pluck hairs, which may have become trapped between them, when the unit is passed over the skin. When the discs are pressed together, the external hair-traps, thus formed, capture mainly hairs located in the center of the device's rotational path. The short hairs, located on the peripheries of the rotational path, are not trapped and consequently, not plucked.

In U.S. Pat. No. 4,575,902 to Alazet; U.S. Pat. No. 5,041,123 to Oliveau, and U.S. Pat. No. 4,960,422 to Demeester, simultaneous closing of blades is complicated and extremely difficult to ensure, while maintaining a uniform gripping force in all hair-traps. These patents describe devices, in which, parallel-positioned plucking blades or disks are fixed, relative to the rod, which carries them. Typically, cam driven motion of the rods causes the blades to close one against the other. On application of force, sufficient gripping force will be attained by some of the blades, while other blades will not be subjected to sufficient force and will remain open.

The difference in plucking-blade response to a given mechanical force is primarily a result of non-uniformity in the production of the unit elements. As a certain level of non-uniformity accompanies all production, correct and efficient performance requires finding a method to decrease, or preferably, eliminate the detrimental effects of non-uniform production.

In order for the blades to close, further force must be exerted, which causes excessive stress on the blades, which closed first. Excessive stress on the blades typically causes hair to be cut instead of plucked. In addition, a certain percentage of plucking attempts is unsuccessful. Each time hairs are pulled, without plucking the hairs, the result is increased pain, increased energy consumption, (which is particularly significant in the case of battery-operated devices), increased noise and excessive wear and tear of parts.

Therefore, it would be desirable to provide a superior power-driven depilatory device, which provides a drastic improvement in the ratio of plucked to cut hairs, while minimizing pain associated with the interval between grasping and plucking of individual hairs.

It would also be desirable to provide a depilatory device, which would reduce noise, and therefore be less frightening to the user.

Furthermore, in the prior art, the depilatory devices were designed, so that to be effective, the user had to hold the device substantially perpendicular to the skin surface, at many times, a most awkward position to work in.

Therefore, it would also be desirable to provide a depilatory device, whose design allows the user to efficiently utilize the device at additional contact angles with the skin surface. This would allow the user to easily maneuver the device, so as to remove hair efficiently, in hard-to-get-to areas, such as the back of the knee joint area. In addition, such a design would also allow the user to easily view the area to be depilated, which was most difficult to do in prior art devices.

Additionally, it would be desirable to provide a depilatory device, whose mechanically correct design will lead to an efficient distribution of the applied force and thereby reduce excessive wear of parts and improve the plucking efficiency.

SUMMARY OF THE INVENTION

Accordingly, it is a principal object of the present invention to overcome the above-mentioned disadvantages and provide a hand-held, motorized depilatory device for removing unwanted skin hair, utilizing a mechanically correct design employing a novel mechanism to spirally align coupled-tweezer elements.

In accordance with a preferred embodiment of the present invention, there is provided a motor-powered depilatory device comprising:

a manually-held housing;

motor means disposed in said housing; and a hair-plucking assembly, exposed through an opening in said housing, and coupled to said motor means, said hair-plucking assembly containing a right hand actuator element and a left hand actuator element, identical in construction, each carrying opposing tweezer elements, which fit together in interleaved fashion, arranged to define hair-traps, said hair-plucking assembly being rotatable about a central shaft and operable to close and open said hair-traps by a system of cams and springs.

Hair-traps are developed by a series of tweezer elements, mounted circumferentially on said hair-plucking assembly. Each of said actuator elements has a pair of carrier arms, containing slots, in which said tweezer elements are mounted. The actuator elements are arranged to provide slots for installation of a plurality rows of tweezer elements, arranged in a staggered, rather than tandem arrangement.

The actuator elements, in the preferred embodiment of the present invention, are made of plastic and are simply designed, and identical in construction, making them inexpensive to manufacture, via injection molding.

On each actuator element, adjacent to the carrier arms are cams, on which are positioned cam followers that are supported by cam follower holders. Two sets of cam followers are held, one at each end, formed by the actuator elements, and are prevented from rotating by an actuator spring. The actuator spring is held in place within a slit, in the body of the appliance, which prevents it from rotating with the hair-plucking assembly. The actuator spring exerts pressure on the ends of the central shaft, which is relayed to the cam follower holders, the cam followers, and through the cams to the actuator elements.

The actuator spring transfers gripping force to the tweezer elements, where gripping force is the specific force required to grip and pluck the hairs. Gripping force is required only at specific points in the operating cycle. During the remainder of the cycle, a retaining spring mounted on the shaft provides the force needed to re-open the hair-traps.

In operation, when the hair-plucking assembly receives rotational motion, the cam followers roll on the cams and when they reach a projection on the cam surface, the actuator elements are pushed one against the other, thereby causing the tweezer elements, of opposing actuator elements, to engage, forming hair-traps on all rows of tweezer elements, simultaneously. Thus, hairs are plucked out, during the rotational motion of the hair-plucking assembly. The cam followers continue rolling along the contour of the cams, eventually arriving at a depression in the cams. At that point, the retaining spring is free to return the actuator elements, as well as the tweezer elements situated on them, to their initial positions, thereby opening the hair-traps, allowing the plucked hair to be released.

Cams are located at each end of the hair-plucking assembly, and are arranged as a set in a circular arrangement, which effectively constitutes a continuous cam arrangement. In the preferred embodiment, a set of four cam followers, arranged perpendicular to each other, is positioned on each set of cams. This correct mechanical design allows the force applied by the actuator spring to be evenly distributed on all points of the cams of the actuator, surrounding the shaft. Thus, the force per point is smaller than in prior art devices, reducing the stress per point, which is an important factor in reducing accelerated wear of parts and excessive noise.

Each tweezer element comprises two wing segments and a central portion. In one of its embodiments, the tweezer element, in its central segment, has formed thereon protrusions. A tweezer element, when engaged, is able to rock slightly around the protrusions. This arrangement permits self-alignment of the tweezer element, thereby enabling uniform distribution of gripping force among all hair-traps. In another embodiment, instead of a protrusion on the tweezer element, a swivel ridge is formed on the wall of the slot, in which the tweezer element is mounted.

The assembly procedure of the hair-plucking assembly is quite simple and rapid. The tweezer elements are snapped into position easily, and held in place by a tongue, or other mechanical means, such as the hair-guide unit, utilized in one of the embodiments.

The tweezer elements are arranged around the hair-plucking assembly, in such a way, that the tips of each tweezer element can engage with the tips of each of two adjacent tweezer elements, so that the tweezer elements form a continuous spiral around the circumference of the assembly. The tweezer elements are able to rock slightly around said protrusions, and thereby align themselves relative to fixed points, provided by a fixed tweezer element. This novel mechanism ensures that all tweezer elements close simultaneously, developing an appropriate equal gripping force, despite inaccuracies in manufacture.

The inventive hair-plucking assembly insures all the hair-traps close simultaneously during a revolution of the hair-plucking assembly, with no excessive applied force being required. Quality of hair plucking is thereby improved, where quality of plucking is defined as the percentage of hairs plucked versus percentage of hairs cut. In prior art devices, excess applied force led to an increase in the number of hairs cut rather than plucked.

The staggered arrangement of tweezer elements contributes to a much more even treatment of the skin surface, and to an increase in the speed of removal of hairs from a given area, thus leading to reduced energy consumption per unit of time.

A further advantage of the present invention is the operation of the actuator elements by the continuity of the cams. The use of four cam followers per cam, eliminates the need to jump from one cam to another, as is the case in, other hair plucking appliances. This configuration decreases noise levels, reduces energy requirements and reduces wear and tear of the device.

Other features and advantages of the invention will become apparent from the drawings and the description contained herein below.

BRIEF DESCRIPTION OF DRAWINGS

For a better understanding of the invention, with regard to the embodiments described, reference is made to the accompanying drawings, in which like numbers designate corresponding elements or sections throughout, and in which.

DETAILED DESCRIPTION OF THE PREFERRED EMBODIMENTS

Figure 2:
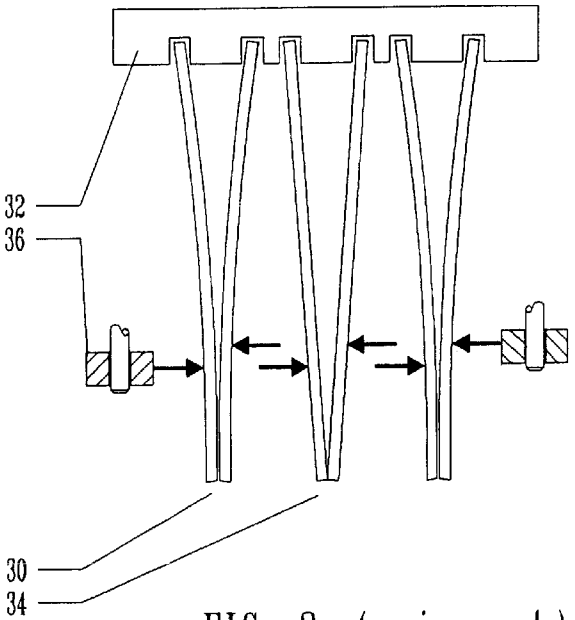
FIG. 2 (prior art)
FIG. 2 schematically illustrates a prior art hair plucking device situation where excess force is exerted in order to ensure closure of all the hair-traps.
Figure 1:
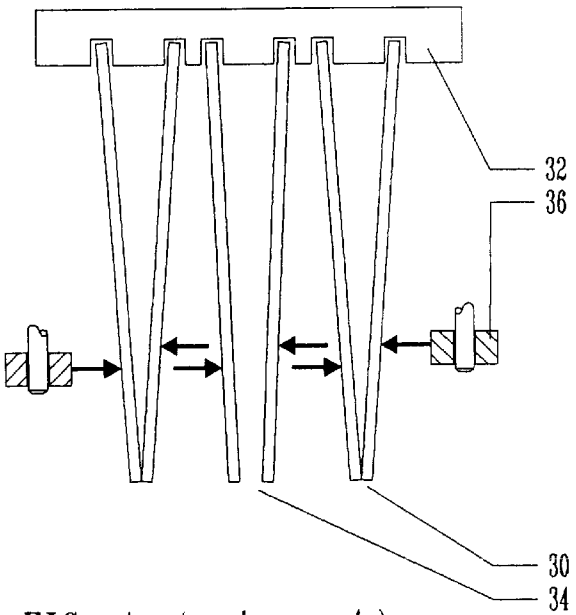
FIG. 1 (prior art)
FIG. 1 schematically illustrates a prior art hair plucking device disadvantage, in which only a portion of the hair-traps are closed, while other traps remain open.

Referring now to prior art FIGS. 1 and 2, there are shown enlarged views of plucking elements 30, each pivotally mounted at one end along the axis of a mounting element 32 to define hair-traps 34. In such an arrangement, even distribution of gripping force is extremely difficult to achieve primarily due to the cumulative effect of production non-uniformities.

As shown in FIG. 1, on application of pressure by an actuator 36, sufficient gripping force will be attained by some of the plucking elements 30, and their corresponding hair-traps 34 will close, while a certain percentage of open hair-traps 34 will not receive sufficient gripping force, and therefore, will remain open. As seen in FIG. 2, in order for the hair-traps of all the plucking elements 30 to close, further pressure must be exerted. Some plucking elements become distorted, and this causes excessive wear, excessive noise, excessive energy consumption, and cuts the hair instead of plucking it. The present invention provides a solution to this problem.

Figure 3:
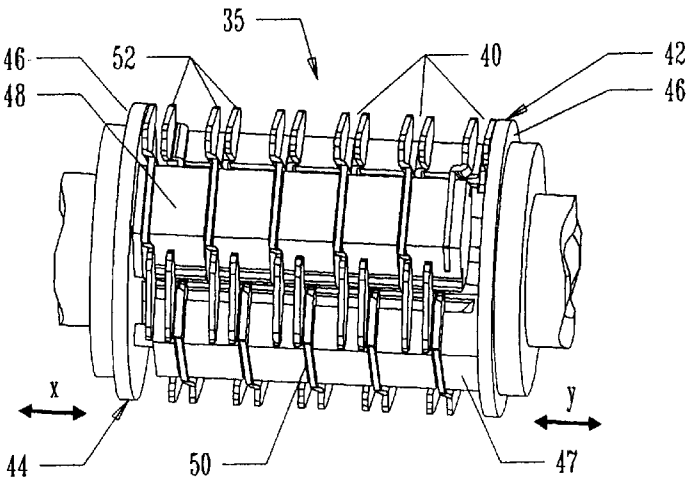
FIG. 3 shows a perspective view of an exemplary embodiment of a hair-plucking assembly for use in a hair depilating device, constructed and operated in accordance with the principles of the present invention.

Referring to FIGS. 3–4, there is shown a perspective view of an exemplary embodiment of a hair-plucking assembly 35, for use in a hair depilating device 36 (FIG. 5), constructed and operated in accordance with the principles of the present invention, the purpose of which is to trap unwanted hairs in hair-traps 40 and to pluck them out from the root. Hair-plucking assembly 35 comprises two identical, opposing actuator elements, a right-hand actuator element 42 and a left-hand actuator element 44 (FIG. 4*a*), which fit together between circular endplates 46. When assembled, hair-plucking assembly 35 has a substantially circular cross-section.

Figure 8:
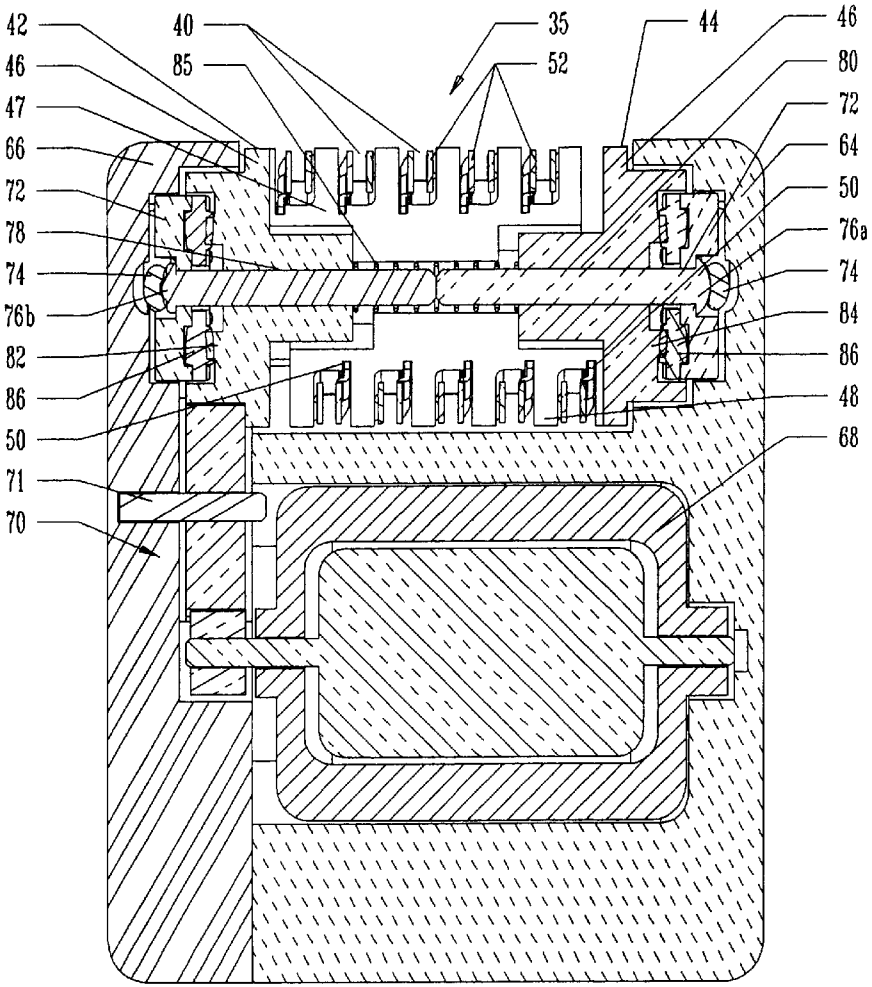
FIG. 8 displays a sectional view of the apparatus taken along the section line VIII—VIII of FIG. 7.

Hair-plucking assembly 35 is driven by a motion conversion mechanism (FIG. 6) that translates the rotational motion of the hair plucking assembly into reciprocating motion of endplates 46 along the longitudinal axis of hair-plucking assembly 35, as indicated by motion arrows X and Y. The detailed components of the mechanism are shown in FIG. 8.

Figure 4B:
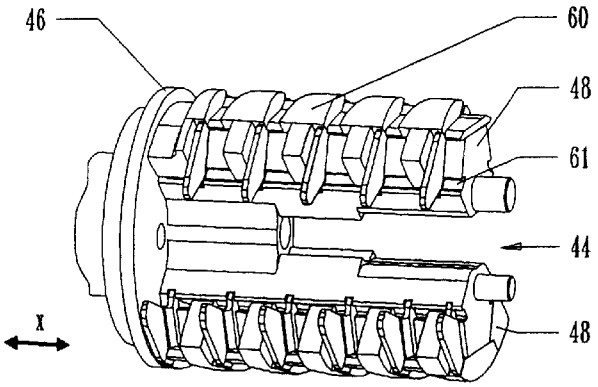
FIGS. 4*a–d* show a single actuator element, illustrating a tweezer element mounting method using a hair guide to hold them in place, while guiding the hairs.
Figure 4C:
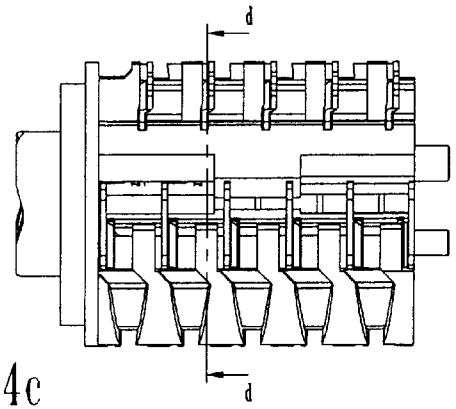
Figure 4D:
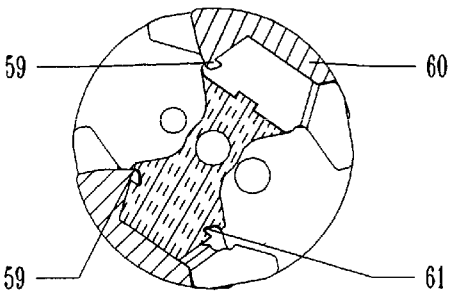
Figure 4A:
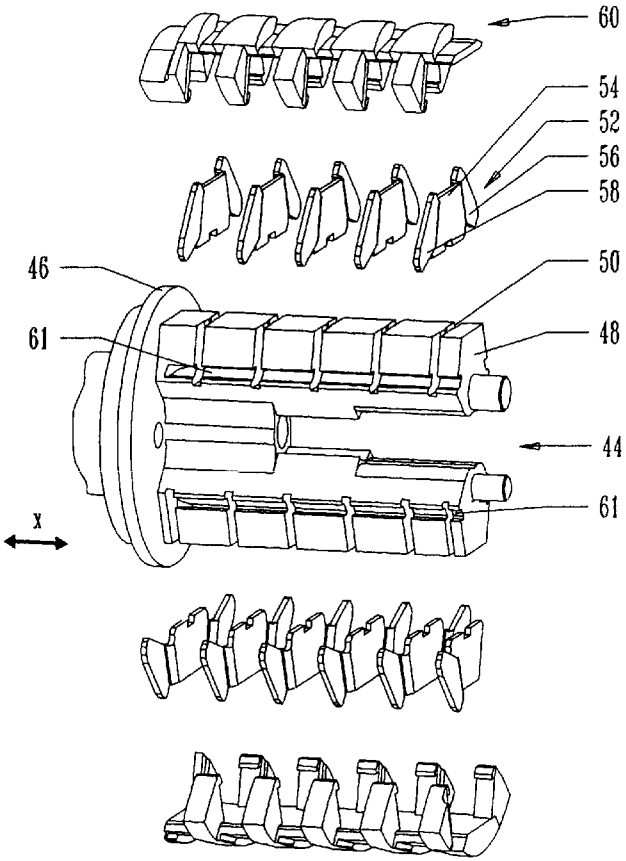

In FIGS. 4*a–b*, there are shown perspective exploded views of the left-hand actuator element 44. In respective actuator elements 42 (FIG. 8) and 44 there are a pair of carrier arms 47, 48. There are formed in carrier arms 47, 48 spaced-apart slots 50, each having seated therein a tweezer element 52, the wings of which are exposed on the periphery of each carrier arm 47, 48. Each tweezer element 52 is shaped as a central portion 54, with peripheral wing sections 56, 58 formed on opposing sides of central portion 54, one wing slightly offset forward of central portion 54 and one behind it, as further illustrated in FIG. 10.

Slots 50 are formed transverse to the longitudinal axis of the hair plucking assembly 35, and tweezer elements 52 are each formed with a pivoting point, which allows longitudinal rocking motion of tweezer elements 52 with respect to the longitudinal axis, within the slot. This enables self-alignment of the tweezer elements 52, as further illustrated in FIG. 15.

Slots 50 on actuator element 48 and slots 50 on actuator element 44 are arranged, such that the wings 56, 58 of the tweezer elements 52, mounted on one actuator element are interleaved with the wings of tweezer elements 52 on the other. Thus, spaces are developed between opposing wings of interleaved tweezer elements 52, these spaces being defined as hair-traps 40. Also shown is hair-guide retaining unit 60, which fits over tweezer elements 52 and holds them in place, while directing the hairs that escape one hair-trap into the path of the next hair-trap, and so forth. Hair-guide retaining unit 60 also completes the cylindrical contour of the hair-plucking assembly 35.

FIG. 4*c* is a side view of the left-hand actuator element 44 of FIG. 4*b*. FIG. 4*d* is a cross-sectional view taken along section line d—d, showing hair guide 60 seated over tweezer element 52, to hold it in place, by snap-in clips 59 which engage grooves 61 formed on the carrier arms 47, 48.

Figure 5:
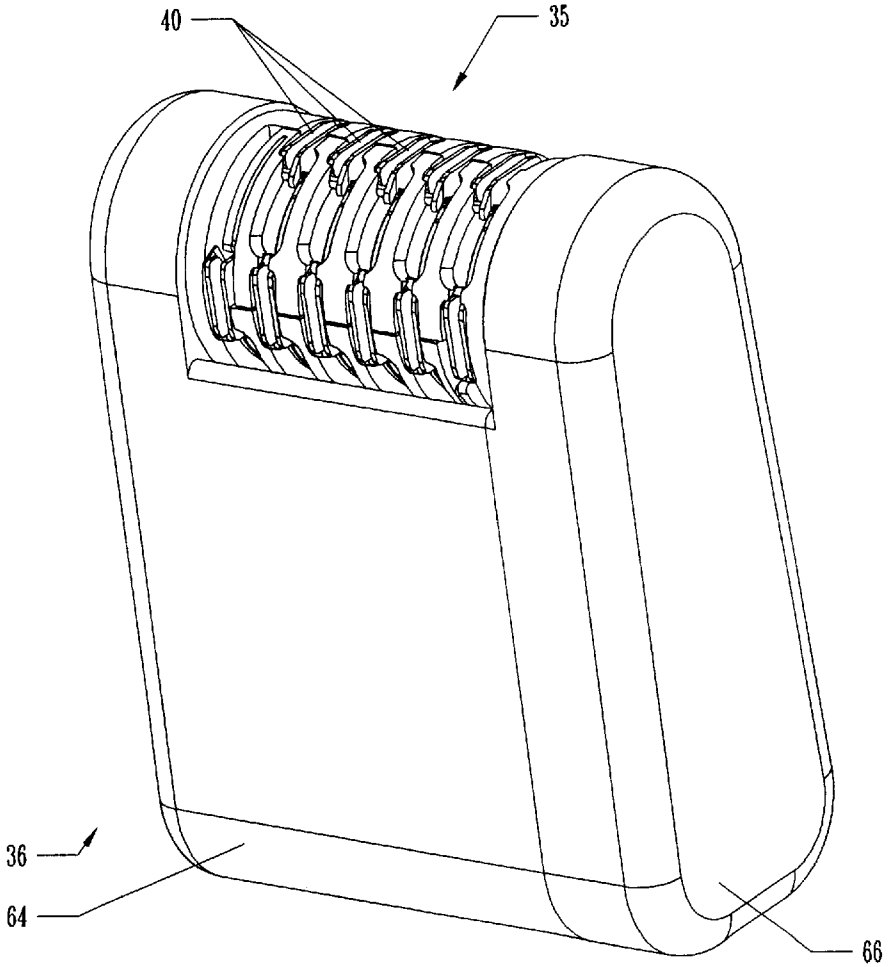
FIG. 5 shows a perspective view of a preferred embodiment of the hair depilating device, using the hair-plucking assembly of FIG. 3.

In FIG. 5, there is shown a perspective view of the exemplary embodiment of hair depilating device 36, which comprises a casing 64, in which there is mounted a hair-plucking assembly 35, as shown in FIGS. 3–4. The hair-plucking assembly 35 comes in contact with the skin via an opening in the casing 64. The casing is connected on one side to a cover 66.

Figure 6:
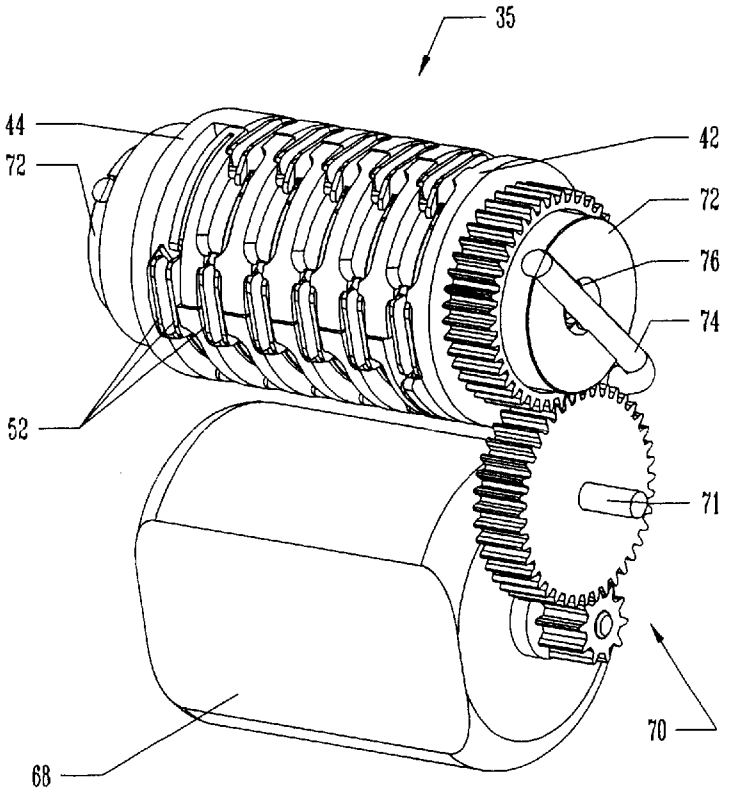
FIG. 6 shows a perspective view of the hair plucking assembly of FIG. 5, without the housing.

As can be seen in the perspective view of FIG. 6, the hair-plucking assembly 35 is driven by an electric motor 68 via a reduction gear 70 rotating on shaft 71. The hair-plucking assembly 35 comprises a right-hand actuator element 42 and a left-hand actuator element 44, which fit together between circular endplates 46, each one identical to the other, and formed integrally with a respective actuator element. Hair-plucking assembly 35 also comprises cam follower holders 72, an actuating spring 74, and a split central shaft 76*a*–*b*. The hair-plucking assembly 35 is designed to have mounted thereon a series of tweezer elements 52.

Figure 7:
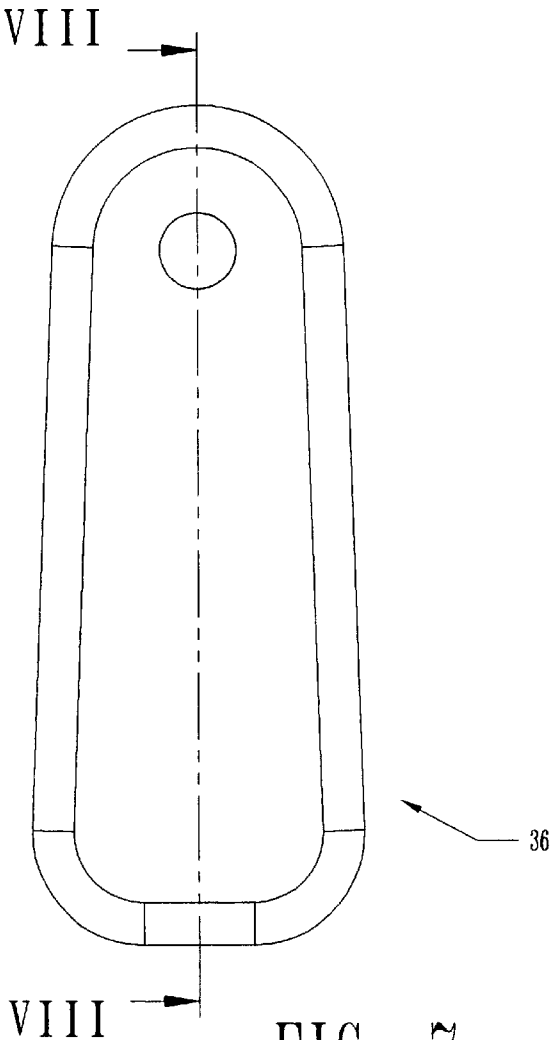
FIG. 7 shows a side view of a preferred embodiment of the depilating device.

FIG. 7 shows a side view of the exemplary embodiment of depilating device 36.

Figure 9:
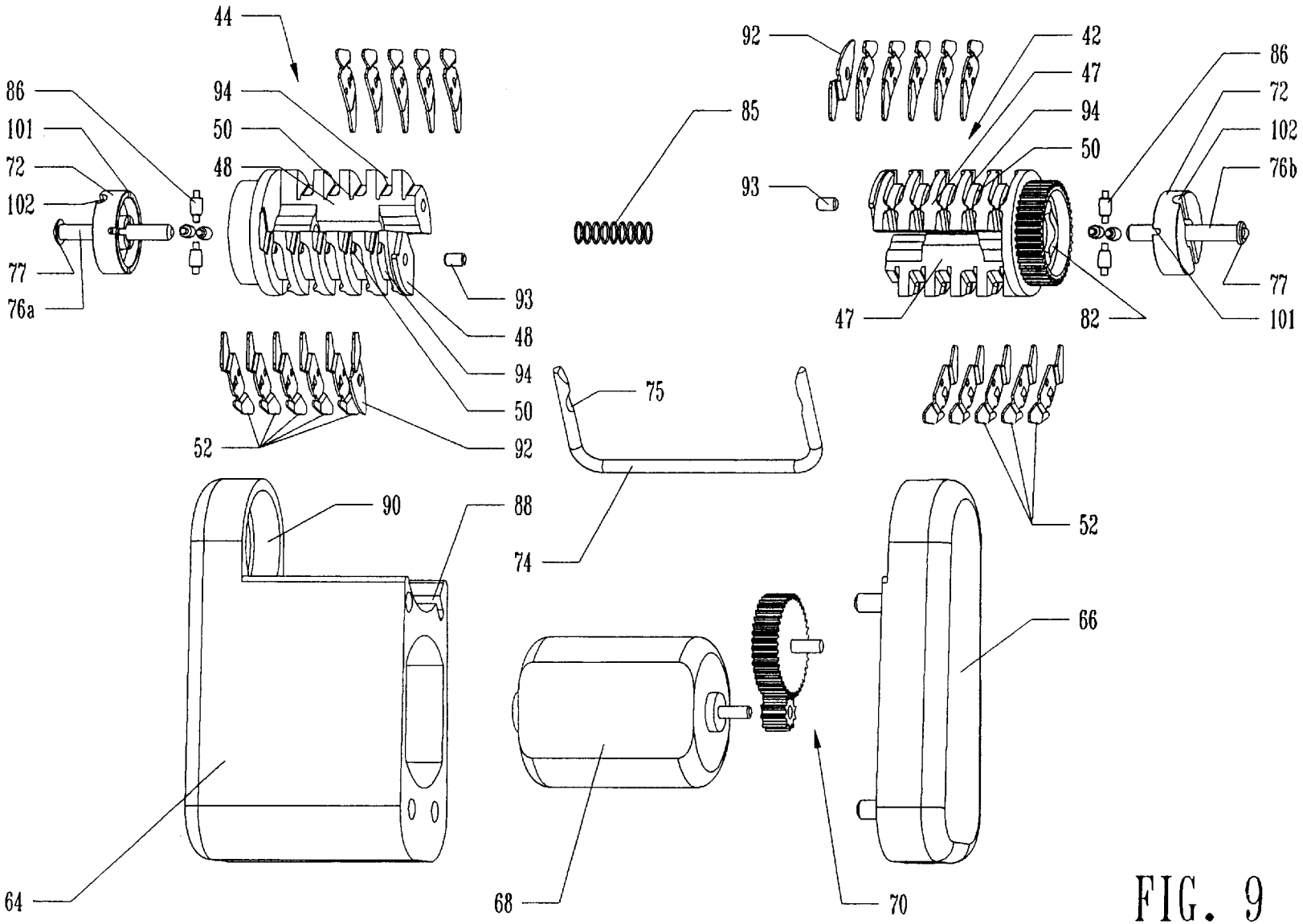
FIG. 9 shows a perspective exploded view of the device shown in FIG. 5.

FIGS. 8 and 9 show further construction details of the hair-plucking assembly 35.

FIG. 8 displays a sectional view of the device 36, taken along section line VIII—VIII of FIG. 7.

In each actuator element 42 and 44, there is a hole, 78 and 80 respectively, which serves as a bearing to the central shaft 76*a*–*b*. On each actuator element, there are integrally formed on endplates 46 a set of cams, 82 and 84, on which are positioned cam followers 86, which are supported by cam follower holders 72. Two sets of identical cam followers 86 are held, one at each end of hair-plucking assembly 35, formed by the actuator elements 42, 44. The cam follower holders 72 are prevented from rotating by an actuator spring 74.

The actuator spring 74 is held in place within a slit 88 (shown in FIG. 9), in the body of the appliance, which prevents the actuator spring from rotating with the hair-plucking assembly 35. There is a niche 75 at each end of the actuator spring 74. As the heads 77 of the central shaft 76*a*–*b* are spherical, they fit smugly into said niches, allowing for excellent self-alignment of the assembly.

The actuator spring 74 presses inwards at the heads of the central shaft 76*a*–*b*, which applies pressure on the cam follower holders 72, which, in turn, transfer the pressure via the mechanism of the cam followers 86, and the cams 82 and 84, to the actuator elements 42 and 44.

The central shaft 76*a*–*b* comprises two identical halves of fixed length, mounted end to end, whose purpose is to provide pretensioning of the actuator spring 74, until the spring is brought into operation. This occurs when the cam followers 86 reach the raised portion on the surfaces of the cams 92 and 84. The purpose of the actuator spring 74 is to transfer gripping force to the tweezer elements 52. Gripping force is the specific force required to grip the hairs and pull them out by the root.

The shaft 76*a*–*b* is important in regulating the resistance to rotation of hair-plucking assembly 35. If there were no shaft, the full magnitude of inwardly-directed force provided by actuator spring 74 would be applied as soon as the assembly 35 began its rotation. This would result in increased resistance to rotational motion and would necessitate a higher energy input by motor 68 to overcome it. There would also be much more noise and greater wear.

The gripping force is only required during a portion of the operating cycle and is only effective during this period. During the remainder of the operating cycle, the full force of the actuator spring 74 is not required, and as described previously, central shaft 76*a*–*b* maintains pretensioning of actuator spring 74. Retaining spring 85 is provided between sections of the central shaft 76*a*–*b,* to hold the hair-traps 40 open, by forcing the actuator elements 42 and 44 apart, until the next time they are driven together by cams 82, 84.

FIG. 9 presents a perspective exploded view of the device shown in FIG. 5. The hair-plucking assembly 35 is contained within a depression 90, formed in one end of casing 64, and cover 66. Cover 66 is located on the opposite end of the casing. The hair-plucking assembly 35 comprises two identically constructed actuator elements, 42 and 44, each of which contains a pair of carrier arms 47 and 48. Each carrier arm 47, 48 is formed with slots 50, which hold the tweezer elements 52.

Each carrier arm has one fixed end blade 92, which does not move from its position and is secured in place by positioning pin 93, or by other mechanical means. Central shaft 76*a*–*b* passes through a hole 78, 80 formed in each actuator element. The grooves 94, formed on carrier arms 47, 48 around the tweezer element slots 50, function to guide the hairs into the hair-traps 40, which are created at the ends of the tweezer elements.

Cams 82, 84 are formed on each end of the hair-plucking assembly 35, comprised of the interleaving actuator elements 42, 44. The cams 82, 84 are arranged as a set of four, in a circular arrangement, which effectively creates a continuous cam arrangement. A set of four cam followers 86, arranged perpendicular to each other, is positioned on each set of cams. The cam followers 86 are mounted so as to be free to rotate in slots 101 of cam follower holders 72, which are supported on shaft 76. The cam follower holders 72 are prevented from rotating by the actuator spring 74, which is situated in slots 102 of the cam follower holders 72.

Figure 21:
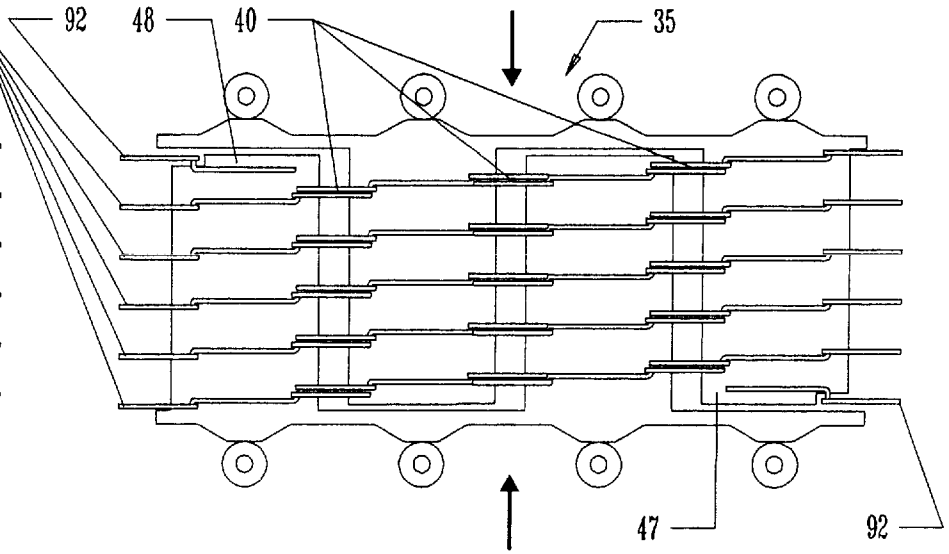
FIG. 21 is a view of the arrangement of FIG. 20, with the tweezer elements in closed hair-trap formation.
Figure 20:
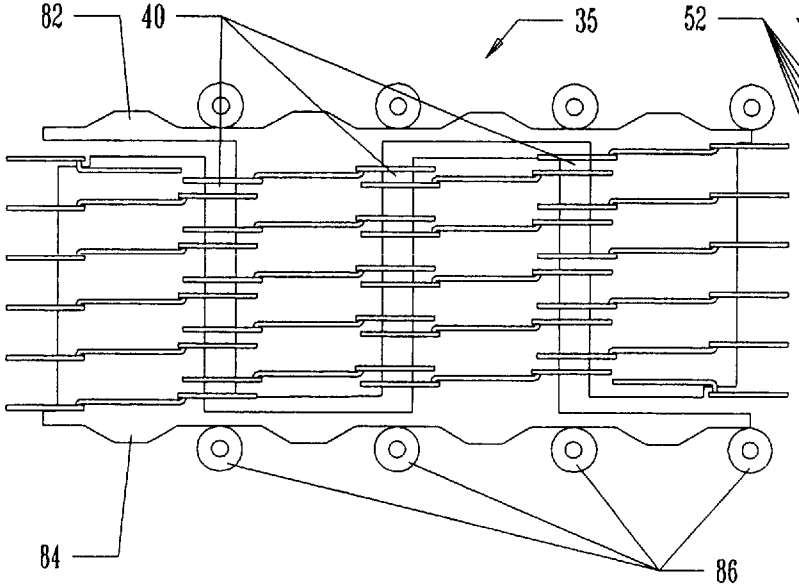
FIG. 20 is a view of the hair-plucking assembly, cut and opened out along its longitudinal axis, with the tweezer elements in open hair-trap formation.

In operation, the hair-plucking assembly 35 receives rotational motion from the motor 68, via the reduction gear 70 (see FIG. 6). The cam followers 86 roll on the cams 82, 84, and when they reach the raised portion of the cam surface, as shown in FIG. 21, actuator element 42 and 44 are pushed one against the other, thereby causing the plucking elements 52, of the opposing actuator elements, to engage, thereby forming hair-traps 40. Thus, hairs are plucked out during the rotational motion of the hair-plucking assembly 35. As shown in FIG. 20, the cam followers 86 continue following the contour of cams 82, 84, eventually arriving at a depression on the cam surface. The retaining spring 85 then causes the actuator elements 42 and 44, together with the tweezer elements 52 mounted on them, to return to their normally open positions, thereby opening the hair-traps 40 and allowing the plucked hair to be released. The process repeats for subsequent rotations of hair-plucking assembly 35.

Figure 10:
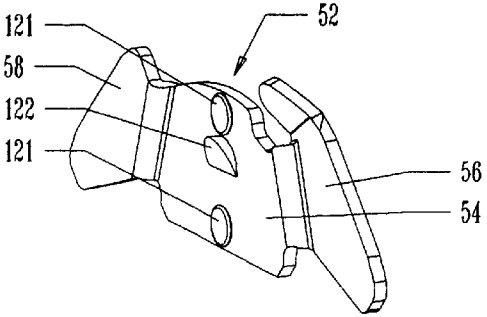
FIG. 10 is a perspective view of a tweezer element.

FIG. 10 is a perspective view of a tweezer element 52. Each tweezer element 52 comprises two wing segments 56, 58 and a central portion 54. In this embodiment, the plucking element 52 in its central segment, has formed thereon protrusions 121, which enables the tweezer element to rock slightly about the protrusions, in the directions shown by the arrows in FIG. 15. The purpose of this design is to permit self-alignment of the tweezer elements, thereby contributing to uniform distribution of gripping force among the hair-traps 40. The tweezer elements 52 are snapped into position in slots 50 and held in place by a tongue 122 or by other mechanical means.

Figure 11:
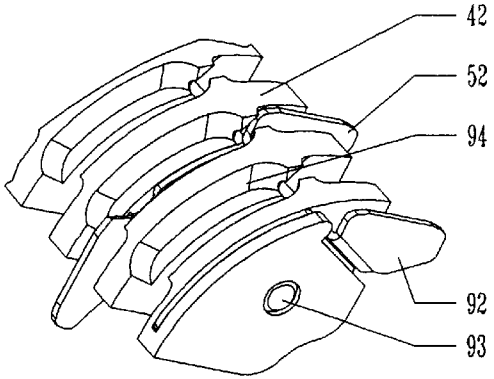
FIG. 11 shows a perspective view of a segment of a carrier arm, showing the tweezer elements within the slots.

FIG. 11 shows a perspective view of a segment of a carrier arm 47 of actuator element 42, showing the tweezer elements 52 mounted within the slots 50. The positioning pin 93, or other mechanical means, holds the fixed tweezer element 92 in place.

Figure 12:
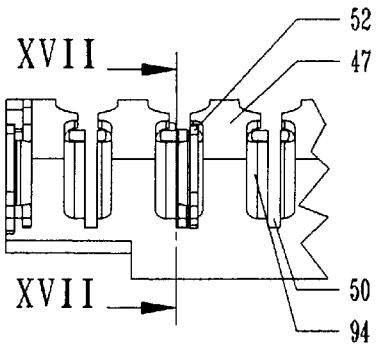
FIG. 12 is a side view of the segment of the carrier arm shown in FIG. 11.

FIG. 12 shows a side view of the segment of carrier arm 47, seen in FIG. 11, showing the tweezer elements 52 within the slots 50 and the adjacent grooves 94 which guide the hairs into the traps 40.

Figure 13:
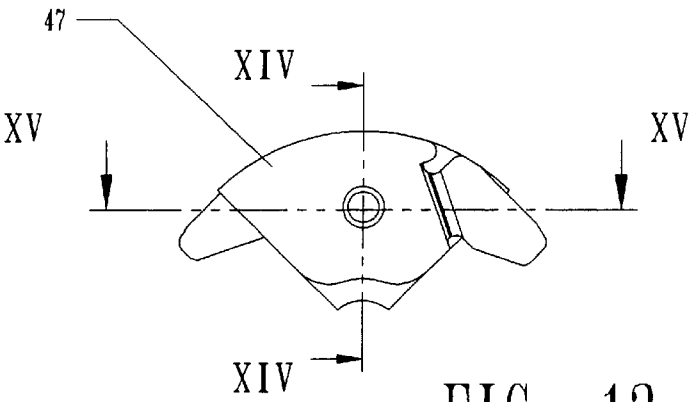
FIG. 13 is a front view of the carrier arm of FIG. 11.

FIG. 13 is a front view of the segment of carrier arm 47, seen in FIG. 11.

Figure 14:
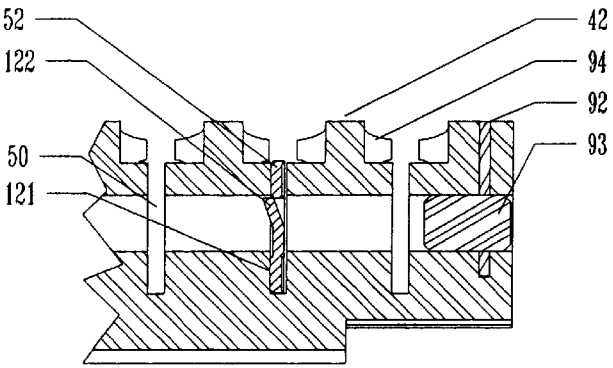
FIG. 14 is a sectional view of the segment of the carrier arm, taken along section line XIV—XIV of FIG. 13.

FIG. 14 shows a sectional view of carrier arm 47, taken along section line XIV—XIV of FIG. 13, in which there is shown tweezer element 52 and its swivel protrusion 121. The tweezer element is held in place by tongue 122. Also shown is a fixed tweezer element 92, which is held in place by positioning pin 93.

Figure 15:
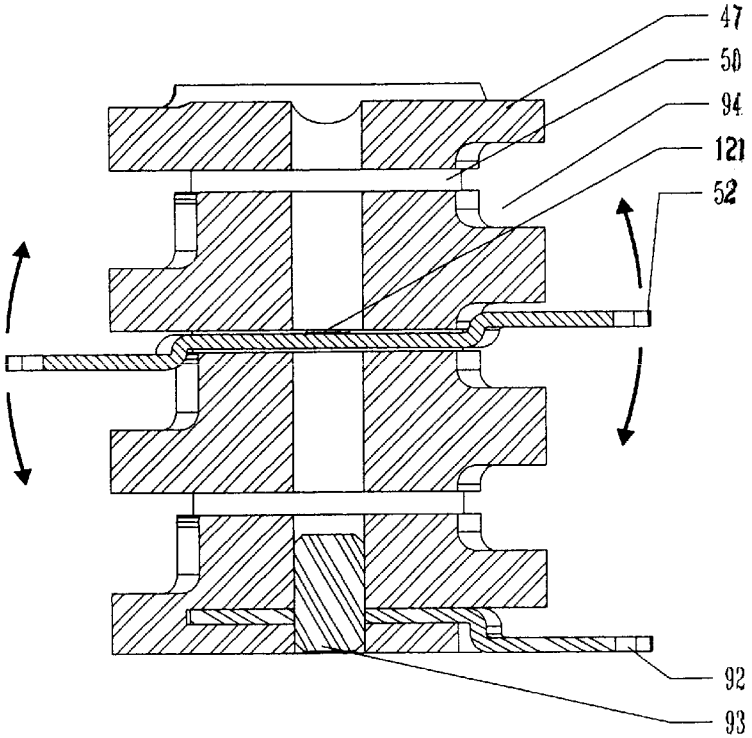
FIG. 15 is a top, sectional view of the segment of the carrier arm, taken along section line XV—XV of FIG. 13.

FIG. 15 is a top, sectional view of carrier arm 47, taken along section line XV—XV of FIG. 13, in which there is shown the mounting of tweezer elements 52, arranged to rock back and forth on carrier arm 47. Also shown is the fixed tweezer element 92, which is held in place by positioning pin 93, slots 50 and the hair-guide grooves 94.

Figure 16:
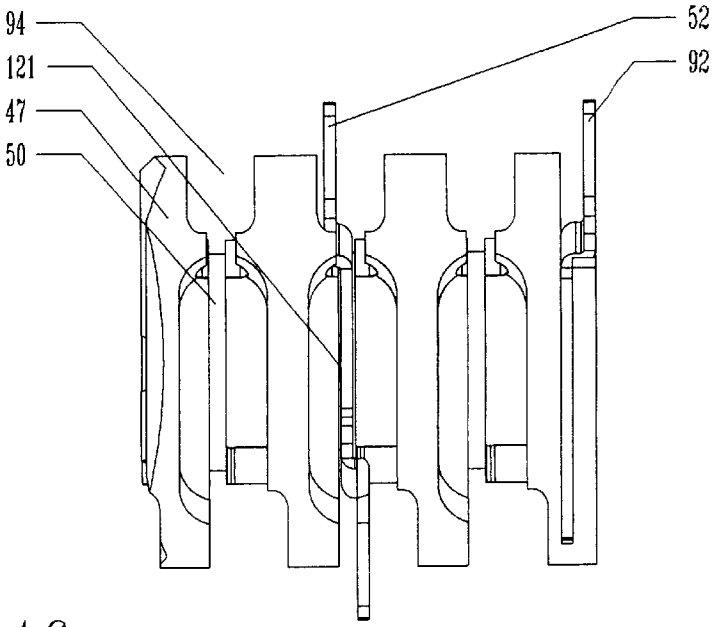
FIG. 16 is a top view of the segment of the carrier arm shown in FIG. 11.

FIG. 16 is a top view of the segment of the carrier arm 47 shown in FIG. 11. FIGS. 15–16 assist the viewer in visualizing the self-alignment possibilities that this device-design allows.

Figure 17:
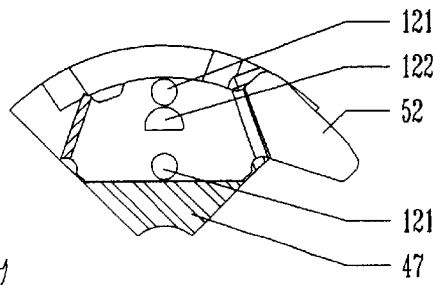
FIG. 17 is a cross-sectional view of the segment of the carrier arm taken along section line XVII—XVII of FIG. 12.

FIG. 17 is a cross-sectional view of a segment of carrier arm 47 taken along section line XVII—XVII of FIG. 12.

Figure 18:
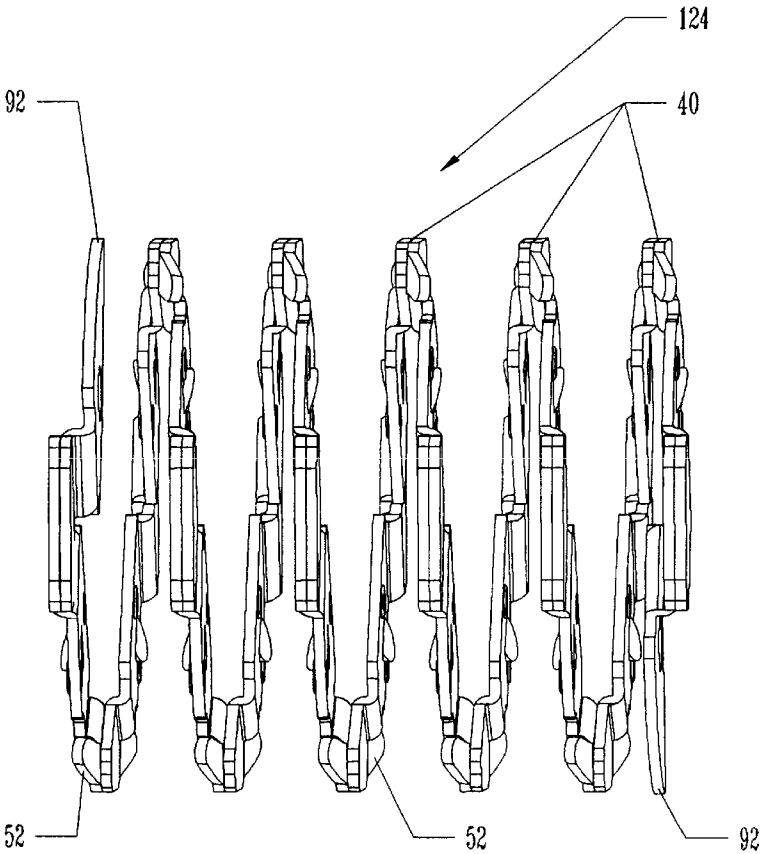
FIG. 18 is a perspective view of the tweezer elements, when all the traps are closed, showing the arrangement as a spiral continuity.

FIG. 18 is a perspective view of the tweezer elements 52, when all the hair-traps 40 are closed, showing the arrangement as a spiral continuity 124.

Figure 19:
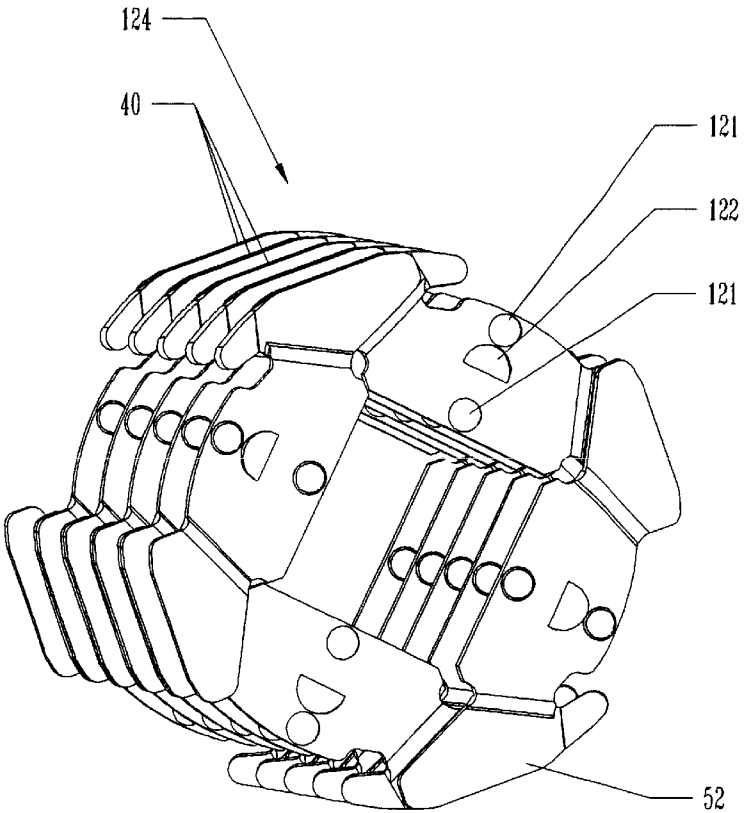
FIG. 19 is an additional perspective view of the tweezer elements in closed hair-trap formation.

FIG. 19 is an additional perspective view of the tweezer elements 52 in closed hair-trap formation. This view better illustrates protrusions 121, providing swivel points enabling efficient gripping force distribution among tweezer elements 52, which are arranged as shown around central shaft 76*a–b* (shaft not shown).

FIGS. 20 and 21 show how the hair-plucking assembly 35 would appear if cut along its longitudinal axis and opened out. This illustration enables an appreciation of the mechanically correct and efficient staggered hair-trap arrangement relative to the surface being depilated.

In FIG. 20, the cam followers 86 have reached the depressions in the surface of the cams 82, 84, and consequently, the hair-traps 40 are open. The continuous cam arrangement can be clearly seen in these figures. The cam followers 86 roll smoothly from cam to cam in a continuous circle, without the need to jump from cam to cam, as occurs in prior art devices. The equalized stress distribution on the cams and cam followers is also apparent, and this reduces wear and tear, noise generation, and energy consumption.

FIG. 21 shows the arrangement of FIG. 20, with the cam followers 86 located on the raised portions of the cams 82, 84, causing the tweezer elements 52, of opposing actuator elements 42 and 44, to close against each other, thereby, closing hair-traps 40.

Figure 22:
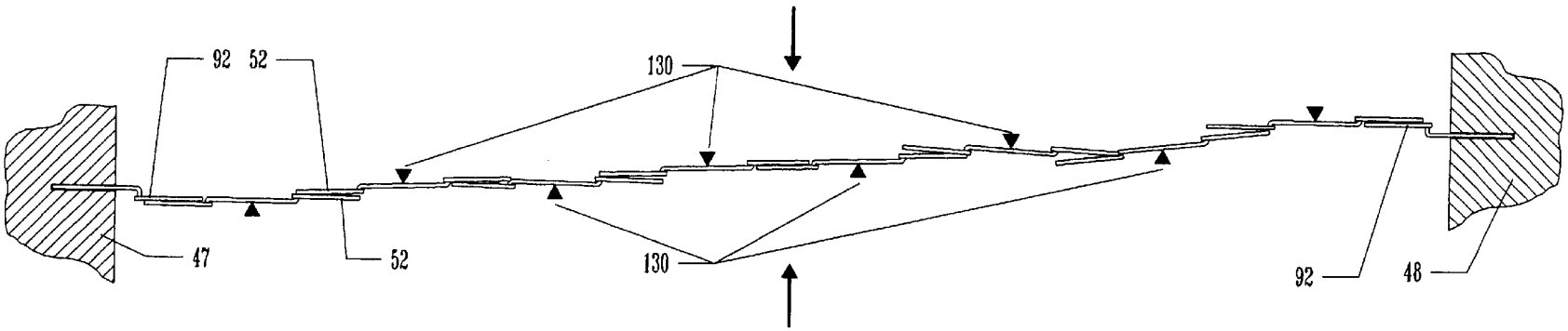
FIG. 22 is a schematic representation of the tweezer elements performing self-alignment.
Figure 23:
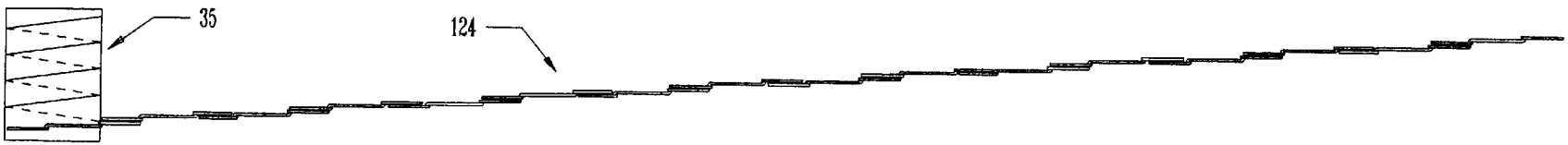
FIG. 23 is a schematic representation of the tweezer elements after self-alignment, and schematically displays the spiral, staggered arrangement of the tweezer elements.

FIG. 22 is a schematic representation of the tweezer elements performing self-alignment. FIG. 23 shows how tweezer elements 52 are arranged around the cylindrical hair-plucking assembly 35, so that the tips of each tweezer element 52 can engage with the tips of each of two adjacent tweezer elements. Thus, the tweezer elements 52 create a continuous spiral 124 around the circumference of the hair-plucking assembly 35, and guarantee self-alignment all along the spiral.

In FIG. 22, the misalignment of the tweezer elements is exaggerated for the purpose of demonstration. The tweezer elements 52 are able to rock slightly around a ridge 130, and thus align themselves relative to fixed points, provided by the fixed tweezer elements 92. This design ensures that all tweezer elements 52 close simultaneously in response to an appropriate gripping force, and even compensates for manufacturing inaccuracies, as illustrated in FIGS. 22 and 23. In FIG. 23, there are also shown schematically the elements 52 spiraling along the circumference of assembly 35.

Figure 24B:
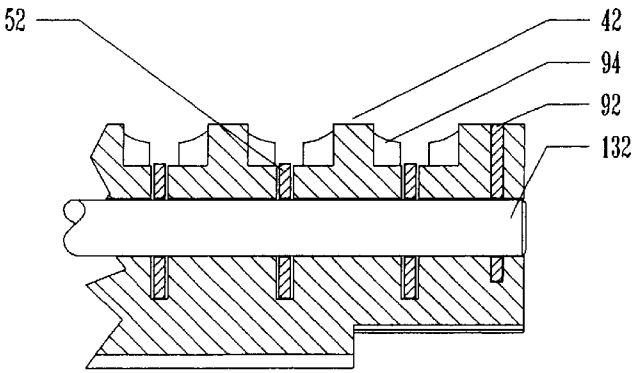
FIGS. 24*a–b* are top and cross-sectional views of a section of the carrier arm, showing an embodiment in which the tweezer element rocks on a swivel ridge that protrudes into the gap between the tweezer element and the slot wall.
Figure 24A:
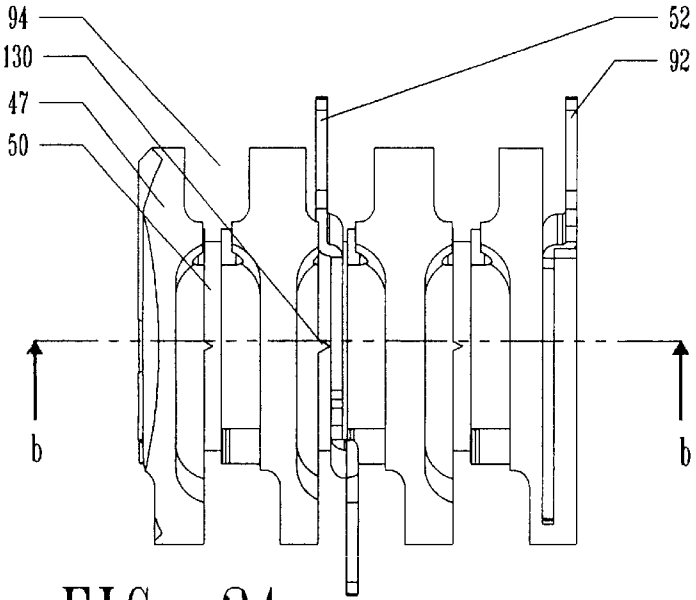

In FIGS. 24*a–b,* there are shown top and cross-sectional views of a segment of carrier arm 47. In this embodiment, the wall of slot 50 has formed thereon a ridge 130, to maintain tweezer element 52 spaced apart from the wall. The tweezer element 52 is able to rock slightly about this ridge protrusion. The purpose of this design is to permit self-alignment of the tweezer elements, thereby contributing to uniform distribution of gripping force among the hair-traps 40.

Figure 25:
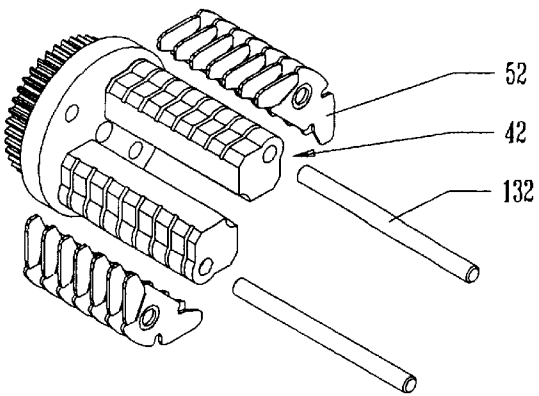
FIG. 25 is a perspective exploded view of an actuator element in an embodiment of the device, showing the tweezer elements mechanically locked in the slots via pins that pass through them, over the actuator element length, FIG. 26 schematically illustrates the additional angles at which the user may hold the device while depilating, to facilitate the depilating process.

In FIG. 25, there is shown a perspective exploded view of an actuator element 42, showing an alternative mechanical locking arrangement of tweezer elements 52 in the slots, using pins 132 (FIG. 24*b*) that pass through them over the actuator length.

Figures 26, 27:
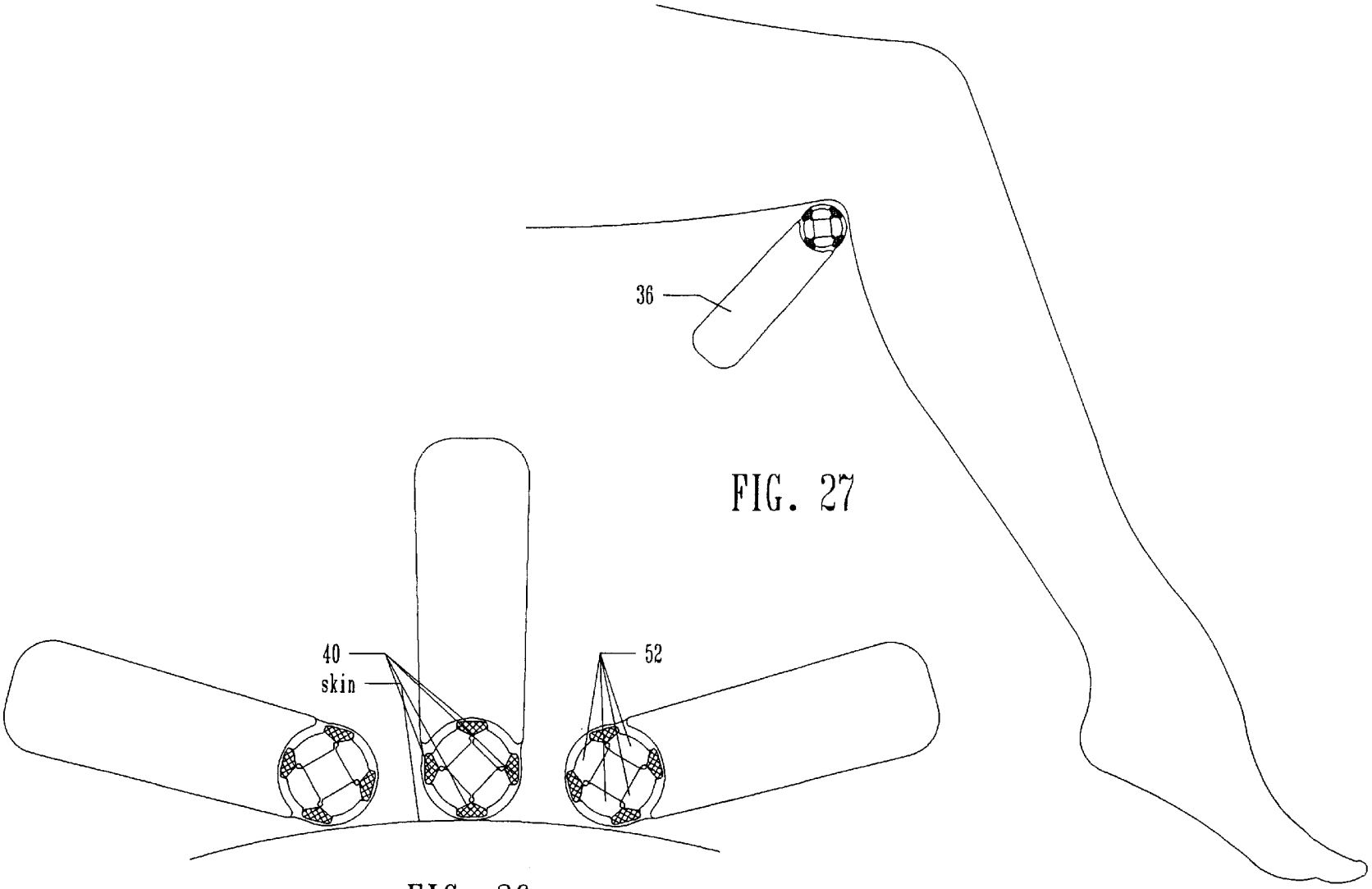
FIG. 27 schematically illustrates use of the device against a hard to reach skin surface, without requiring a change in the angle at which the device is applied.

In FIG. 26, there is shown a schematic representation of four depilating zones on the invention's hair-plucking assembly periphery. In accordance with the present invention, four depilating rows are employed on the periphery of hair plucking assembly 35, and up to three zones may be exposed simultaneously, thereby facilitating depilation in hard-to-reach areas.

In FIG. 27, there is shown a schematic representation of the device 36 depilating a hard-to-reach area behind the knee joint. The device may be held at one particular angle, without requiring adjustment on passing between portions of the leg.

Figure 28:
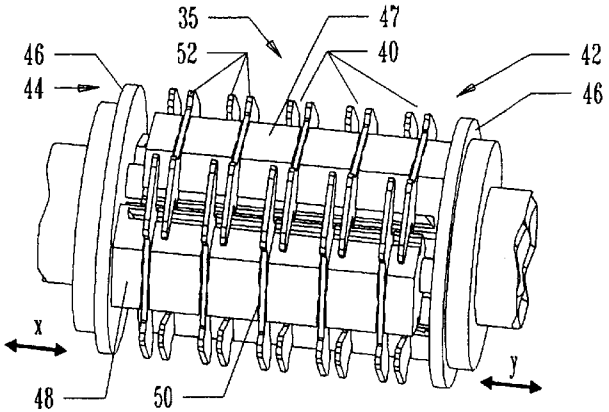
FIG. 28 shows an alternative embodiment of the hair-plucking assembly, featuring an annular grouping of tweezer elements.

FIG. 28 shows an alternative embodiment of the hair-plucking assembly 35, featuring an annular grouping of tweezer elements 52.

Figure 29:
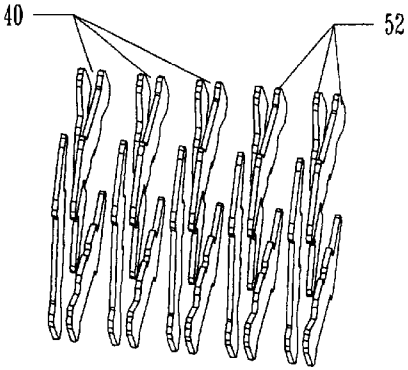
FIG. 29 is a perspective view of the tweezer elements, when all the traps are open, showing the arrangement of the annular grouping.

FIG. 29 is a perspective view of the tweezer elements 52, when all the hair-traps 40 are open, showing the arrangement the annular grouping.

Figure 30:
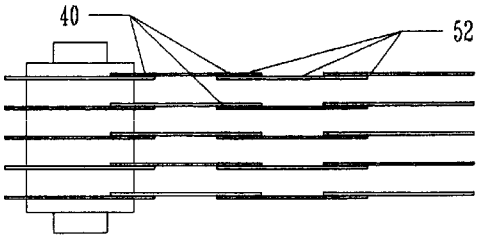
FIG. 30 is a schematic representation of the tweezer elements after self-alignment, and schematically displays the annular grouping of the tweezer elements.

FIG. 30 is a schematic representation of the tweezer elements 52 after self-alignment, and schematically displays the annular grouping of the tweezer elements. FIG. 30 shows how the tweezer elements are arranged around the cylindrical hair-plucking assembly, so that the tips of each tweezer element 52 can engage with the tips of each of two adjacent tweezer elements. In this embodiment, the tweezer elements are arranged in four discrete annular groupings. Within each grouping, self-alignment is performed.

Figure 31:
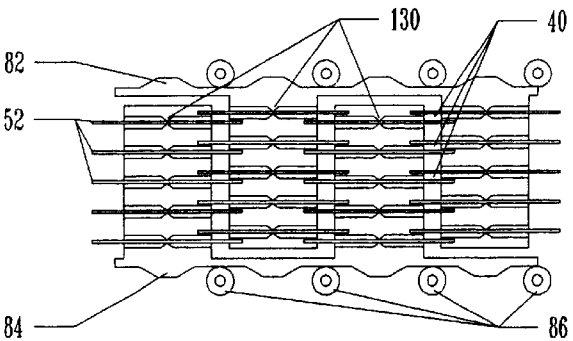
FIG. 31 is a view of the hair-plucking assembly of FIG. 28, cut and opened out along its longitudinal axis, with the tweezer elements in open hair-trap formation.

FIG. 31 is a view of the hair-plucking assembly of FIG. 28, cut and opened out along its longitudinal axis, with tweezer elements 52 in open hair-trap 40 formation.

Figure 32:
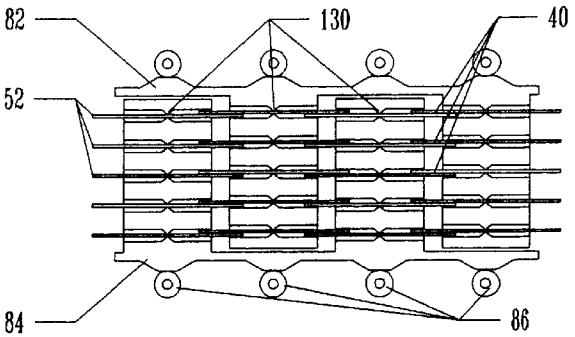
FIG. 32 is a view of the arrangement of FIG. 31 with the tweezer elements in closed hair-trap formation.

FIG. 32 is a view of the arrangement of FIG. 31 with the tweezer elements 52 in closed hairtrap 40 formation.

Having described the invention with regard to a certain specific embodiment, it is to be understood that the description is not meant as a limitation since further modifications may now suggest themselves to those skilled in he art, and it is intended to cover such modifications, as fall within the scope of the appended claims.

I claim:

1. A motor-powered depilating device comprising:

a manually-held housing;

motor means disposed in said housing; and a hair-plucking assembly, exposed to a skin surface via an opening in said housing defining a longitudinal axis, and being coupled to said motor and supported by said housing so as to be capable of rotational motion, said assembly comprising a pair of oppositely-facing actuator elements each having a plurality of carrier arms extending therefrom, said carrier arms formed with a plurality of spaced apart slots in which a plurality of tweezer elements are mounted, so as to be parallel to one another, said actuator elements arranged to fit together such that said tweezer elements are interleaved, within said hair-plucking assembly, and form hair-traps between proximate tweezer element ends, each of said actuator elements having a hole formed centrally therein, through which there extends a central shaft, on which said actuator elements are movable in reciprocal fashion towards and away from each other, ends of said actuator elements having mounted thereon cams for causing said reciprocal motion during portions of said rotational motion, each of said tweezer elements comprising a central segment, bordered on each end by a wing segment, said tweezer element being mounted in said slot such that it can rock slightly therein with respect to said longitudinal axis, thus enabling self-alignment of said tweezer elements one with respect to another, such that when said hair-plucking assembly receives rotational motion from said motor, said cams push said actuator elements one against the other, causing said tweezer elements of said opposing actuator elements to engage and form said hair-traps, thereby plucking hair when said hair-traps are closed, and when said actuator elements return to their initial positions, releasing said plucked hair.

2. The device of claim 1 wherein said actuator elements are identical in construction.

3. The device of claim 1, wherein said cams, located on each end of said hair-plucking assembly, are arranged as a plurality in a circular arrangement, which effectively constitutes a continuous cam arrangement, whereby said actuator elements are provided with smooth reciprocal motion.

4. The device of claim 1 wherein said tweezer elements are situated circumferentially in said slots, without passing through the center of said hair-plucking assembly, thus greatly simplifying device assembly.

5. The device of claim 1, wherein said tweezer elements are arranged around said hair-plucking assembly, so that said wing segments of said tweezer elements can engage with wing segments of other interleaved tweezer elements so as to form a continuous spiral arrangement of tweezer elements around the circumference of said hair-plucking assembly, thereby providing uniform closure of said hair-traps.

6. The device of claim 1 wherein said hair-plucking assembly defines a plurality of rows of tweezer elements around its circumference, more than one row of tweezer elements being exposed and operative at one time, enabling operation of the device at additional contact angles with the skin surface, and enabling depilation in hard-to-reach skin areas, without adjusting the contact angle.

7. The device of claim 1 wherein said tweezer element is mechanically engaged in said slot to retain it therein and to enable said self-alignment.

8. The device of claim 1 wherein said tweezer element is formed with a hole for engaging a pin to retain it within said slot.

9. The device of claim 1 wherein said tweezer element is formed with a tongue to prevent dislodgement from said slot.

10. The device of claim 1 wherein said slot is formed with a ridge for maintaining said tweezer element spaced apart from a wall of said slot, to enable said self-alignment.

11. The device of claim 1, wherein said tweezer elements are arranged around said hair-plucking assembly, so that said wing segments of said tweezer elements can engage with wing segments of other interleaved tweezer elements so as to form a series of separately grouped, annular arrangements of tweezer elements mounted around the circumference of said hair-plucking assembly, thereby providing uniform closure of said hair-traps in said groups.

12. The device of claim 1 further comprising a hair-guide retaining unit which fits over said tweezer elements to retain them in said slots and complete a cylindrical contour of said hair-plucking assembly, for directing hairs that escape one hair-trap into the next hair-trap, during said rotational motion.

13. The device of claim 1 further comprising an actuator spring providing inwardly-directed force against said actuator elements, and a retaining spring mounted on said central shaft to force said actuator elements apart, said actuator spring developing a gripping force between said tweezer elements during a portion of the operating cycle, while during the remainder of the operating cycle when said actuator force is not required, said retaining spring maintains pretensioning of actuator spring, thereby reducing noise and wear.

14. A method of removing unwanted hair using a motor-powered depilating device, said method comprising the steps of:

providing a manually-held housing having motor means disposed therein;

providing a hair-plucking assembly exposed to a skin surface via an opening in said housing defining a longitudinal axis, and being coupled to said motor and supported by said housing so as to be capable of rotational motion, said assembly comprising a pair of oppositely-facing actuator elements each having a plurality of carrier arms extending therefrom, said carrier arms formed with a plurality of spaced apart slots in which a plurality of tweezer elements are mounted, so as to be parallel to one another, said actuator elements arranged to fit together such that said tweezer elements are interleaved, within said hair-plucking assembly, and form hair-traps between proximate tweezer element ends, each of said actuator elements having a hole formed centrally therein, through which there extends a central shaft, on which said actuator elements are movable in reciprocal fashion towards and away from each other, ends of said actuator elements having mounted thereon cams for causing said reciprocal motion during portions of said rotational motion, each of said tweezer elements comprising a central segment, bordered on each end by a wing segment, said tweezer element being mounted in said slot such that it can rock slightly therein with respect to said longitudinal axis, thus enabling self-alignment of said tweezer elements one with respect to another; and providing said hair-plucking assembly with rotational motion from said motor, causing said cams to push said actuator elements one against the other, whereby said tweezer elements of said opposing actuator elements engage and form said hair-traps, thereby plucking hair when said hair-traps are closed, and when said actuator elements return to their initial positions, releasing said plucked hair.

15. The method of claim 14 wherein said hair-plucking assembly can be held against the skin surface at more than one angle to enhance visual perception of contact with the skin surface while operating said depilating device.

16. The method of claim 14 wherein said hair-plucking assembly defines a plurality of rows of tweezer elements around its circumference, more than one row of tweezer elements being exposed and operative at one time, enabling operation of the device at additional contact angles with the skin surface, and enabling depilation in hard-to-reach skin areas, without adjusting the contact angle.

17. A motor-powered depilating device comprising:

a manually-held housing;

motor means disposed in said housing; and a hair-plucking assembly, exposed to a skin surface via an opening in said housing defining a longitudinal axis, and being coupled to said motor and supported by said housing so as to be capable of rotational motion, said assembly comprising a pair of oppositely-facing actuator elements each having a plurality of carrier arms extending therefrom, said carrier arms formed with a plurality of spaced apart slots in which a plurality of tweezer elements are mounted, so as to be parallel to one another, said actuator elements arranged to fit together such that said tweezer elements are interleaved, within said hair-plucking assembly, and form hair-traps between proximate tweezer element ends, each of said actuator elements having a hole formed centrally therein, through which there extends a central shaft, on which said actuator elements are movable in reciprocal fashion towards and away from each other, ends of said actuator elements having mounted thereon cams for causing said reciprocal motion during portions of said rotational motion, each of said tweezer elements comprising a central segment, bordered on each end by a wing segment, said tweezer element being mounted in said slot such that it can rock slightly therein with respect to said longitudinal axis, thus enabling self-alignment of said tweezer elements one with respect to another, such that when said hair-plucking assembly receives rotational motion from said motor, said cams push said actuator elements one against the other, causing said tweezer elements of said opposing actuator elements to engage and form said hair-traps, thereby plucking hair when said hair-traps are closed, and when said actuator elements return to their initial positions, releasing said plucked hair.

18. The device of claim 17 wherein said tweezer elements are arranged around said hair-plucking assembly, so that said tweezer elements can engage other interleaved tweezer elements so as to form a continuous spiral arrangement of tweezer elements around the circumference of said hair-plucking assembly, thereby providing uniform closure of said hair-traps.

19. The device of claim 17, wherein said tweezer elements are arranged around said hair-plucking assembly, so that said tweezer elements can engage other interleaved tweezer elements so as to form a series of separately grouped, annular arrangements of tweezer elements mounted around the circumference of said hair-plucking assembly, thereby providing uniform closure of said hair-traps in said groups.

* * * * *